United States Patent [19]

Watanabe et al.

[11] Patent Number: 4,653,378

[45] Date of Patent: Mar. 31, 1987

[54] PEDAL KEYBOARD FOR ELECTRONIC MUSICAL INSTRUMENT

[75] Inventors: Keisuke Watanabe; Toshiyuki Iwamoto, both of Shizuoka, Japan

[73] Assignee: Nippon Gakki Seizo Kabushiki Kaisha, Hamamatsu, Japan

[21] Appl. No.: 734,952

[22] Filed: May 16, 1985

[30] Foreign Application Priority Data

| | | | |
|---|---|---|---|
| May 25, 1984 | [JP] | Japan | 59-75874[U] |
| May 25, 1984 | [JP] | Japan | 59-75875[U] |
| Jan. 9, 1985 | [JP] | Japan | 60-494[U] |
| Feb. 14, 1985 | [JP] | Japan | 60-18365[U] |

[51] Int. Cl.[4] ..... G10C 3/12

[52] U.S. Cl. ..... 84/423 R; 84/366; 84/434; 84/444

[58] Field of Search ..... 84/225-231, 84/423 R, 426, 434, 436, 444, 365, 366

[56] References Cited

U.S. PATENT DOCUMENTS

| | | | |
|---|---|---|---|
| 3,026,760 | 3/1962 | Fauser | 84/423 R |
| 3,527,134 | 9/1969 | Muraki | 84/366 |
| 4,479,415 | 10/1984 | Haberstumpf | 84/423 R |

FOREIGN PATENT DOCUMENTS

| | | |
|---|---|---|
| 47-10213 | 4/1972 | Japan . |
| 57-11584 | 1/1982 | Japan . |

*Primary Examiner*—Benjamin R. Fuller

*Attorney, Agent, or Firm*—Blakely, Sokoloff, Taylor & Zafman

[57] ABSTRACT

A pedal keyboard for an electronic musical instrument, includes a pedal key vertically pivotal about a pivot mechanism mounted on a frame of a housing for the electronic musical instrument, a spring for biasing the pedal key so as to cause the pedal key to return to an initial position, and a stopper for limiting pivotal movement of the pedal key. The spring is arranged behind the pivot mechanism of the pedal key, and the stopper is arranged behind the spring, thereby improving key depression feeling and forming a gap in the pivot mechanism to achieve smooth pivotal movement of the key.

27 Claims, 23 Drawing Figures

PEDAL KEYBOARD FOR ELECTRONIC MUSICAL INSTRUMENT

BACKGROUND OF THE INVENTION

The present invention relates to a pedal keyboard for an electronic musical instrument.

In an electronic musical instrument such as an electronic organ in which a key switch is opened or closed upon depression of a key in a manual keyboard to electrically generate a musical tone with a predetermined pitch corresponding to the depressed key, a musical tone output from a tone generator is also controlled by a pedal keyboard to generate a musical tone with an artistic expression. A conventional pedal keyboard is disposed at a lower portion of the front surface of the housing so as to be vertically movable. Many requirements are imposed on such a pedal keyboard: the pedal keyboard must have a simple structure, easily installed, provide smooth and sharp movement and have a good stop with little noise. Various mechanisms for the pedal keyboard have been conventionally proposed. A conventional pedal keyboard comprises foot keys vertically pivotable, springs for biasing the foot keys so as to return them to initial positions, respectively, and stoppers for limiting the pivotal movement of the foot keys. Conventional foot key arrangements are illustrated in FIGS. 1A to 1E. Throughout FIGS. 1A to 1E, reference numeral 1 denotes a pedal key; 2, a pivot 2 for the pedal key 1; 3, a spring for biasing the pedal key 1 so as to return it to the initial position; 4*a*, an upper limit stopper; and 4*b*, a lower limit stopper. In a structure shown in FIG. 1A, the upper and lower stoppers 4*a* and 4*b* are located near a front end portion (player's side) of the pedal key 1, and the spring 3 is located behind the upper and lower stoppers 4*a* and 4*b* to bias the pedal key 1 upward. The pivot 2 is located behind the spring 3 so as to support the pedal key upward. Referring to FIG. 1B, the spring 3, the pivot 2 and the upper and lower stoppers 4*a* and 4*b* are arranged with respect to the pedal key 1 from the player's side to the side away from the player. In this case, the spring 3 biases the pedal key 1 upward, and the pivot 2 is mounted on the pedal key 1. Referring to FIG. 1C, the upper stopper 4*a*, the spring 3, the pivot 2 and the lower stopper 4*b* are sequentially arranged with respect to the pedal key 1 from the player's side to the side away from the player. In this case, the spring 3 biases the pedal key upward and the pivot 2 is mounted on the pedal key 1. Referring to FIG. 1D, the upper and lower stoppers 4*a* and 4*b*, the pivot 2 and the spring 3 are sequentially arranged with respect to the pedal key 1 from the player's side to the side away from the player. In this case, the spring 3 biases the pedal key 1 downward, and the pivot 2 supports the pedal key 1 upward. In a structure shown in FIG. 1E, the upper stopper 4*a*, the pivot 2, the spring 3 and the lower stopper 4*b* are sequentially arranged with respect to the pedal key 1 from the player's side to the side away from the player. In this case, the spring 3 biases the pedal key 1 downward, and the pivot 2 supports the pedal key 1 thereon. Now assume that stop feeling of the pedal key is considered. In order to obtain good stop feeling, some distance should be provided between the pivot 2 and the lower stopper 4*b*. However, in cases wherein the spring 3 is located in front of the pivot 2 as shown in FIG. 1B, the upper stopper 4*a* is located in front of the pivot 2 as shown in FIGS. 1C and 1E, and the spring 3 is located behind the pivot 2 as shown in FIG. 1A, the depth of a frame 5 which forms a bottom portion of the instrument housing and on which the pedal keys are mounted becomes large in size, resulting in inconvenience.

In the structure of FIG. 1A wherein the spring 3 is located between the pivot 2 and the upper and lower stoppers 4*a* and 4*b*, the size of the frame 5 can be decreased. However, since the pedal keys 1 are arranged on the lower surface of the frame 5, the spring 3 must comprise a tension spring, or a spring seat member located under the pedal key 1 must be integrally formed with the frame and a compression coil spring must be inserted between the spring seat member and the pedal key 1. According to the former construction, hooks are provided at two ends of the tension spring and are hooked to the pedal key 1 and the frame 5. The assembly operation becomes complicated, and spring forces vary. As a result, uniform musical performance cannot be accomplished. According to the latter structure, since the spring seat member is required, the assembly operation of the member on the frame 5 results in high cost.

SUMMARY OF THE INVENTION

It is, therefore, a principal object of the present invention to provide a low cost pedal keyboard for an electronic musical instrument wherein good stop feeling can be obtained, and a depth of a frame can be decreased with respect to the overall instrument size.

It is another object of the present invention to provide a pedal keyboard wherein a support structure provides a good pivot feeling by the interference-preventive support structure.

It is still another object of the present invention to provide a pedal keyboard wherein mounting of a pedal key structure is improved.

In order to achieve the above object of the present invention, there is provided a pedal keyboard for an electronic musical instrument, comprising:

a pedal key vertically pivotal about a pivot mechanism mounted on a frame which is fixed to a body of the musical instrument;

a spring for biasing the pedal key so as to cause the pedal key to return to an initial position; and a stopper for limiting pivotal movement of the pedal key, the spring being arranged behind the pivot mechanism of the pedal key, and the stopper being arranged behind the spring.

DESCRIPTION OF THE PREFERRED EMBODIMENTS

Figure 1A:
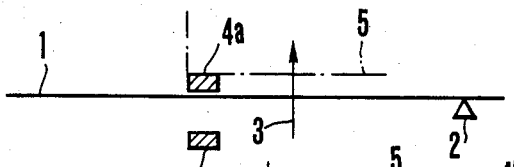
PRIOR ART FIG. 1A
FIGS. 1A to 1E are diagrams showing the positional relationships between the pivots, springs and stoppers of conventional pedal keyboards, respectively.
Figure 1B:
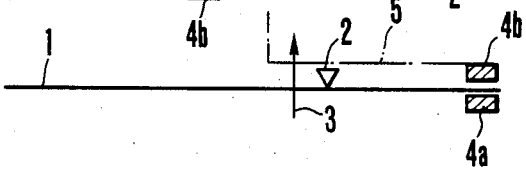
Figure 1C:
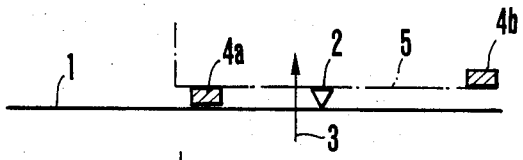
Figure 1D:
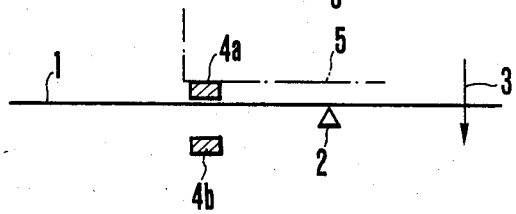
Figure 1E:
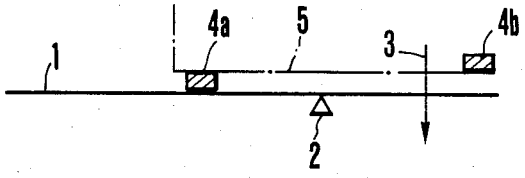
Figure 2:
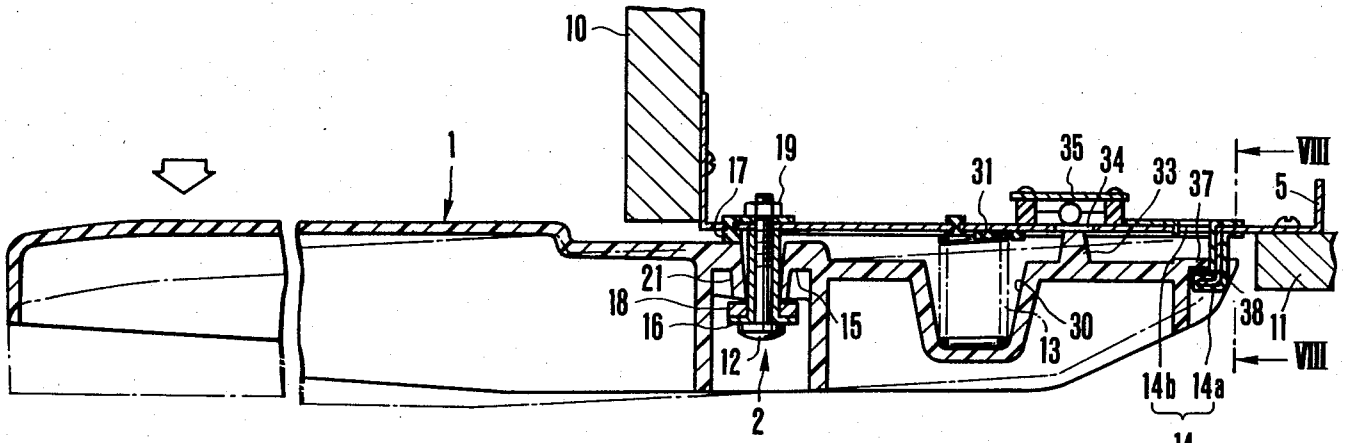
FIG. 2 is a sectional view of a pedal keyboard for an electronic musical instrument according to an embodiment of the present invention.

FIGS. 2 to 7 show a pedal keyboard according to an embodiment of the present invention. The left-hand side of FIG. 2 is the side of player which is hereinafter referred to as "front" and the right-hand side as "rear". Referring to FIGS. 2 to 7, reference numeral 10 denotes a front board of a musical instrument housing; and 11, a bottom board. The lower end of the front board 10 is coupled by a frame 5 to the front end of the bottom board 11. Foot keys 1 are arranged on the lower surface of the frame 5.

Each pedal key 1 has a substantially inverted U-shaped structure of, for example, plastic. The rear end portion of the pedal key 1 is vertically pivoted about a support shaft 12 constituting a pivot mechanism 2 at the lower surface of the frame 5. The pedal key 1 is biased clockwise by a spring 13 mounted on the rear portion thereof. The pivotal movement of the pedal key 1 is limited by a stopper 14 arranged behind the spring 13.

Figure 3:
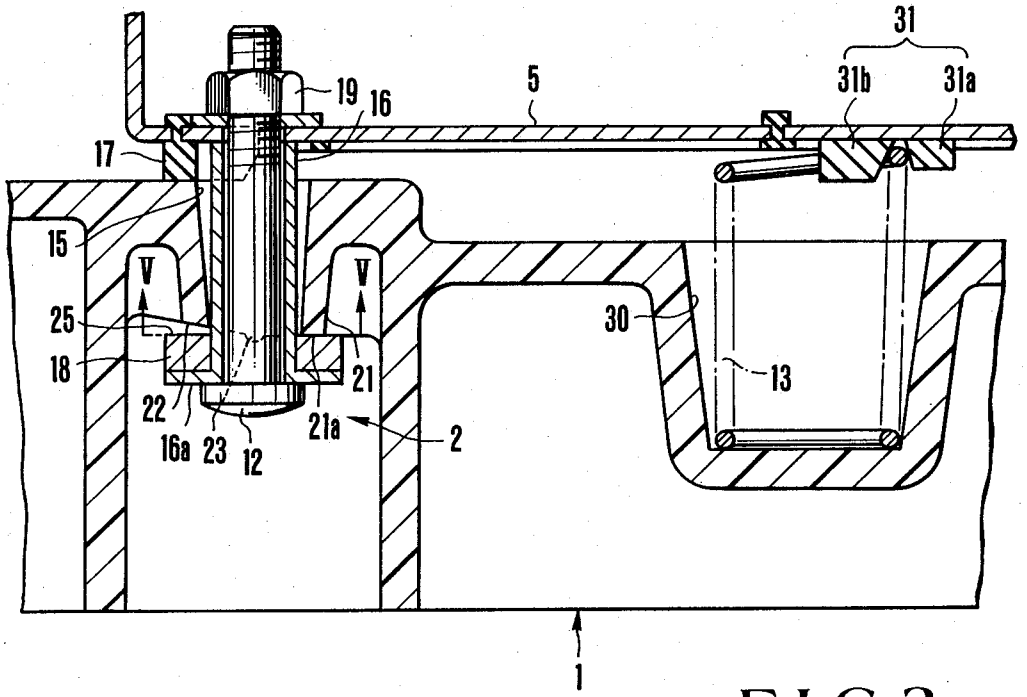
FIG. 3 is an enlarged sectional view showing the main part of the pedal keyboard when the keyboard is not operated.
Figure 4:
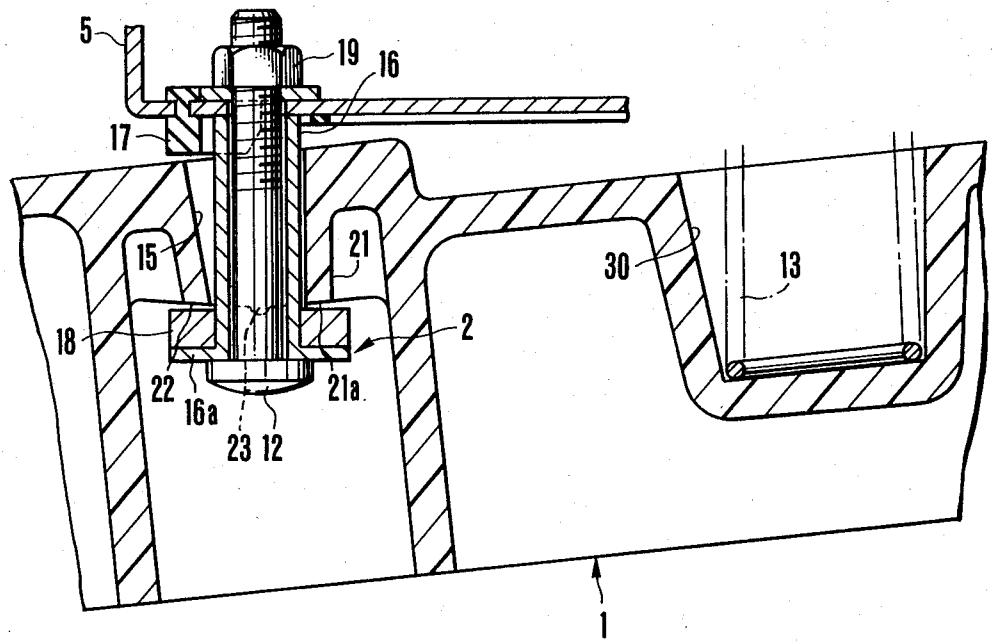
FIG. 4 is an enlarged sectional view showing the main part of the pedal keyboard when a key in the keyboard is depressed.
Figure 5:
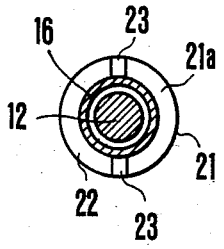
FIG. 5 is a sectional view of the pedal keyboard taken along the line V—V of FIG. 3.

The pivot mechanism 2 is best illustrated in FIGS. 3, 4 and 5. The pivot mechanism 2 comprises the support shaft 12 vertically inserted from the lower direction in a hole 15 through a cylindrical spacer 16 with a lower end flange **16*a*, so that the spacer 16 defines an effective length of the shaft 12. The hole 15 is formed in the pedal key 1 and tapered toward the bottom. The pivot mechanism 2 also comprises a pair of upper and lower elastic (e.g., rubber) members 17 and 18 mounted on the upper and lower surfaces of the pedal key 1. The support shaft 12 comprises a bolt. The distal end of the bolt extends upward from the frame 5 through the through hole formed therein. The extended portion of the bolt is threadably engaged with a nut 19. The head of the bolt serves as a block portion together with the elastic member 18 and the flange 16*a* of the spacer 16. A cylindrical portion 21 integrally suspends from the lower surface of the pedal key 1. The central hole of the cylindrical portion 21 is tapered to constitute the hole 15. The opening (the front end side of the pedal key 1 from a center of a lower end face 21*a* of the cylindrical portion 21) of the lower end of the hole 15 is cut at a desired inclination angle to constitute an inclined surface 22. When the pedal key is not depressed, i.e., when the pedal key is kept in a static state, a gap is formed between the elastic member 18 and the inclined surface 22. A projection 23 formed at the central portion along the back-and-forth direction of the lower end face 21*a* extends below the hole 15 in a direction perpendicular to the longitudinal direction of the pedal key 1, as shown in FIGS. 3 and 5. The projection 23 serves as a pivot of the pedal key 1** and has a semicircular cross-sectional shape.

Figure 6:
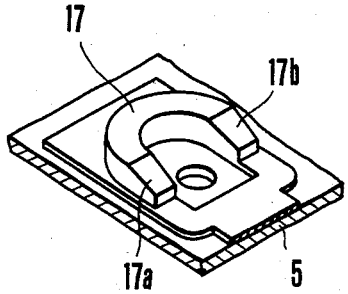
FIG. 6 is a perspective view of an upper elastic member.

As shown in FIG. 6, the substantially C-shaped upper elastic member 17 has a rectangular cross-sectional shape. The elastic member 17 is located between the pedal key 1 and the frame 5 so as to surround the upper end portion of the cylindrical spacer 16 at the front end side of the pedal key 1. The two end faces of the elastic member 17 are obliquely cut to constitute inclined surfaces **17*a* and 17*b* so as to provide gaps with the pedal key. The inclined surfaces 17*a* and 17*b* of the elastic member 17 are formed extending beyond the axis of the shaft toward the front end of the key. The inclined surfaces 17*a* and 17*b* are effectively used to prevent interference between the pedal key 1 and the elastic member 17 when the pedal key 1 is depressed. The elastic member 17 is integrally formed by outsert molding with the frame 5**.

The lower elastic member 18 comprises a ring which has a rectangular cross-sectional shape so as to fit with the spacer 16. The lower elastic member 18 is inserted between the lower end face **21*a* of the cylindrical portion 21 and the flange 16*a* of the spacer 16. Therefore, a wedge-shaped gap 25 is formed between the inclined surface 22 of the lower end face 21*a* and the upper front half of the elastic member 18, thereby preventing interference between the cylindrical portion 21 and the elastic member 18 upon depression of the pedal key 1**.

As shown in FIG. 4, when the pedal key 1 is depressed, the pedal key 1 is pivoted about the projection 23 counterclockwise. When a maximum inclined angle is obtained, the inclined surface 22 is substantially horizontal and comes closer to or is brought into slight contact with the upper front half of the elastic member 18, thereby substantially preventing interference. Therefore, the elastic member 18 is not compressed, and pivotal movement of the pedal key 1 will not be adversely affected. In addition, since the elastic member 17 has a substantially C-shaped structure, its two end lower surfaces will not interfere with the pedal key 1 due to the presence of the inclined surfaces **17*a* and 17*b*. Therefore, pivotal movement of the pedal key 1 will not be adversely affected either by this upper elastic member 17**.

Accordingly, the pedal key 1 will not receive a reaction force of the elastic members 17 and 18 upon rotation of the key. When the pedal key 1 begins to be inclined, the pedal key 1 is brought into substantially linear contact with the elastic members, thereby smoothly providing sharp operation.

Figure 7:
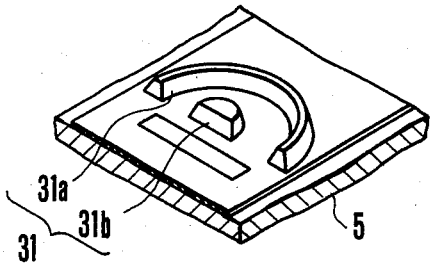
FIG. 7 is a perspective view of a spring housing member.

The spring 13 comprises a compression coil spring. The lower end of the spring 13 is housed in a spring housing recess 30 formed in the upper surface of the lower portion of the pedal key 1 behind the hole 15. The upper end of the spring 13 abuts against the lower surface of the frame 5. The spring housing recess 30 comprises a tapered hole. The diameter of the bottom portion of the recess 30 is substantially the same as the outer diameter of the coil spring 13, thereby preventing right-and-left and back-and-forth movement of the lower end of the spring 13. However, a projection having substantially the same diameter as the output diameter of the spring 13 may extend from the wall of the recess and engage with the lower end of the spring. Movement of the upper end of the spring 13 is limited by the spring housing member 31 formed on the lower surface of the frame 5. The spring housing member 31 is integrally formed simultaneously when the upper elastic member 17 is formed by outsert molding. As shown in FIG. 7, the spring housing member 31 has a trapezoidal sectional shape. The spring housing member 31 comprises an arcuated projection 31*a* having an inner diameter which is substantially the same as the outer diameter of the spring 13 and a trapezoidal projection 31*b* located inside the projection 31*a*.

An actuator 33 (FIG. 2) is integrally formed with the upper rear end portion of the pedal key 1 behind the spring housing recess 30. A through hole 34 is formed and a switch 35 is arranged in the frame 5 in correspondence with the actuator 33. The switch 35 is operated by the actuator 33 upon depression of the pedal key 1. A signal from the switch 35 controls generation of the pedal musical tone.

A projection 37 is integrally formed with the rear end face of the pedal key 1, and the stopper 14 is disposed in correspondence with the projection 37. The stopper 14 comprises a substantially hook-like upper stopper 14*a* normally engaged with the lower surface of the projection 37 integrally formed with the frame 5 and a lower stopper 14*b* of rubber which is fixed on the lower surface of the frame 5 in correspondence with the projection 37. The two ends of the projection 37 extend backward to constitute a substantially U-shaped member. The upper stopper 14*a* is inserted between the extended portions of the projection 37, thereby preventing right-and-left pivotal movement of the pedal key 1. The projection 37 is urged upward against the upper stopper 14*a*, so that the pedal key 1 is held substantially horizontal. The pedal key 1 is pivoted counterclockwise through a small angle, as indicated by the alternate long and two short dashes line of FIG. 2. A buffer 38 of felt or the like is disposed at a portion of the stopper 14*a* to be engaged with the projection of the pedal key 1, thereby preventing generation of shock noise.

According to the pedal keyboard with the arrangement described above, the stopper 14 is arranged so as to be spaced a predetermined distance apart from the support shaft 12, so that good stop feeling (feeling given when the rear end of the pedal key 1 abuts against the lower end stopper 14*b*) upon depression of the pedal key 1 is obtained. In addition, since the spring 13 is located between the support shaft 12 and the stopper 14, the depth of the frame 5 can be minimized. A compression coil spring is used as the spring 13, and assembly can be easily performed. Therefore, variations in spring forces can be minimized to allow the player to depress keys with a uniform force.

Figure 8:
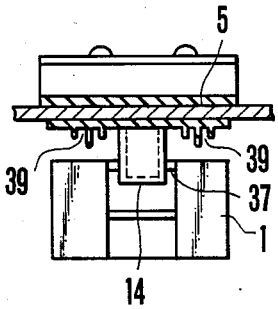
FIG. 8 is a sectional view of the keyboard taken along the line VIII—VIII of FIG. 3.

A plurality of projections 39 facing downward and forming a part of the lower limit stopper 14*b* may be formed on the lower surface of the frame 5 as shown in FIG. 8. These projections 39 are parallel along the longitudinal direction of the pedal key, thereby absorbing shock generated upon contact between the pedal key and the lower stopper 14*b* and preventing generation of noise.

The present invention is not limited to the particular embodiment described above. Various changes and modifications may be made. For example, the pedal keys are made of a plastic material but can be made of a metal.

In the above embodiment, the spring housing members 30 and 31 for the spring 13 are arranged in the pedal key 1 and the frame 5, respectively. However, only one spring housing member may be used. The arrangement of the pivot mechanism of the pedal key 1 need not be limited to that in the above embodiment and various modifications can be made.

The hole formed in the pedal key so as to extend the support shaft therein may be a groove or a notch.

In the above embodiment, the spacer 16 is mounted on the support shaft 12 to set the effective length of the support shaft to be constant. However, if the threaded portion of the support shaft is limited, the same effect as in the above embodiment can be obtained.

The pedal keys 1 are arranged on the lower surface of the frame 5 in the above embodiment. However, the present invention is not limited to this arrangement. For example, the pedal keys 1 may be arranged on the upper surface of the frame 5.

In the above embodiment, the front half of the lower end face 21*a* of the cylindrical portion 21 serves as the inclined surface 22 to form the gap 25 with the lower elastic member 18. However, the upper front half of the elastic member 18 may be formed to be an inclined surface.

In the above embodiment, the hole 15 is formed in the pedal key 1. However, the hole 15 may be replaced with an open groove on one side surface of the pedal key 1.

As described above, the pedal keyboard of the electronic musical instrument according to the present invention comprises a pivot or mechanism of the pedal key, a spring for biasing the pedal key which is returned to the initial position, and a stopper for limiting the pivotal movement of the pedal key, the pedal key, the spring and the stopper being arranged from the front end to the rear end of the pedal key. Therefore, the stop feeling upon depression of the pedal key is improved, and the depth of the frame for holding the pedal keys can be minimized. In addition, a compression coil spring is used as the spring 13 to manufacture the pedal keyboard at low cost, thus providing a great practical effect. A gap is formed between the lower end opening (at the front side of the pedal key) of the through hole or groove formed in the pedal key and the lower elastic member (at the front side of the pedal key). This gap prevents interference between the pedal key and the elastic member upon depression of the pedal key, thereby guaranteeing smooth movement of the pedal key and improving operability. The structure is simple, and only a few components of the conventional pedal keyboard must be replaced to obtain the above-mentioned effect. In this manner, the state-of-the-art products can be easily improved, thereby obtaining great advantage.

FIGS. 9 to 12 show another embodiment of a pedal keyboard mounting structure for an electronic musical instrument according the present invention. Referring to FIGS. 9 to 12, a frame lock member 120 is fixed on the front end face of the lower surface of a bottom board 112 between a front board 110 and a rear board 114 to hold and fix the front end of a frame 105.

The frame lock member 120 integrally comprises a base 120A which is obtained by metal plate pressing and extends along the right-and-left direction of a housing 102 and which is fixed by a set screw 121 at the lower portion of the inner wall surface of the front board 110, a lower bent portion 120B which is obtained by bending the lower end portion of the base 120A backward perpendicularly to the extending direction of the base 120A, and upper bent portions 120C obtained such that the upper end portion of the base 120A is bent backward perpendicularly to the longitudinal direction of the base 120A to be spaced a predetermined distance apart from the lower bent portion 120B. Each upper bent portion 120C is fixed by a set screw 122 on the lower surface of the bottom board 112, and together with the lower bent portion 120B constitutes a holding portion 123 for holding the front end of the frame 105. Screw holes 124 and 125 are formed in the base 120A and the upper bent portion 120C, respectively.

In the above embodiment, the front end of the bottom board 112 is fixed on the lower end of the inner wall surface of the front board 110 through the frame lock member 120. However, the present invention is not limited to this arrangement. For example, the front board 110 and the bottom board 112 may be directly fixed with each other, and the frame lock member 120 may be fixed on the front end of the lower surface of the bottom board 112. In this case, the frame lock member 120 may comprise a substantially U-shaped member.

The frame 105 having pedal keys **103*a* is flat in the same manner as in the conventional frame. However, the front and rear end portions of the frame 105 are bent upward perpendicularly to the extending direction of the frame 105. A hook-like engaging portion 127 having a distal end bent backward and a fixing portion 128 are integrally formed with the frame 105. The height of the engaging portion 127 is substantially the same as the distance between the lower and upper bent portions 120B and 120C. The leading end portion of a horizontal portion 127*a* of the engaging portion 127 is bent downward. The engaging portion 127 is formed in correspondence with each vertical mounting portion 120D. However, the engaging portion 127 may be formed along the entire length of the frame 105. The fixing portion 128 is formed along the entire longitudinal direction of the frame 105, and a horizontal portion 128*a* thereof has a plurality of screw holes 129** at equal intervals.

Figure 9:
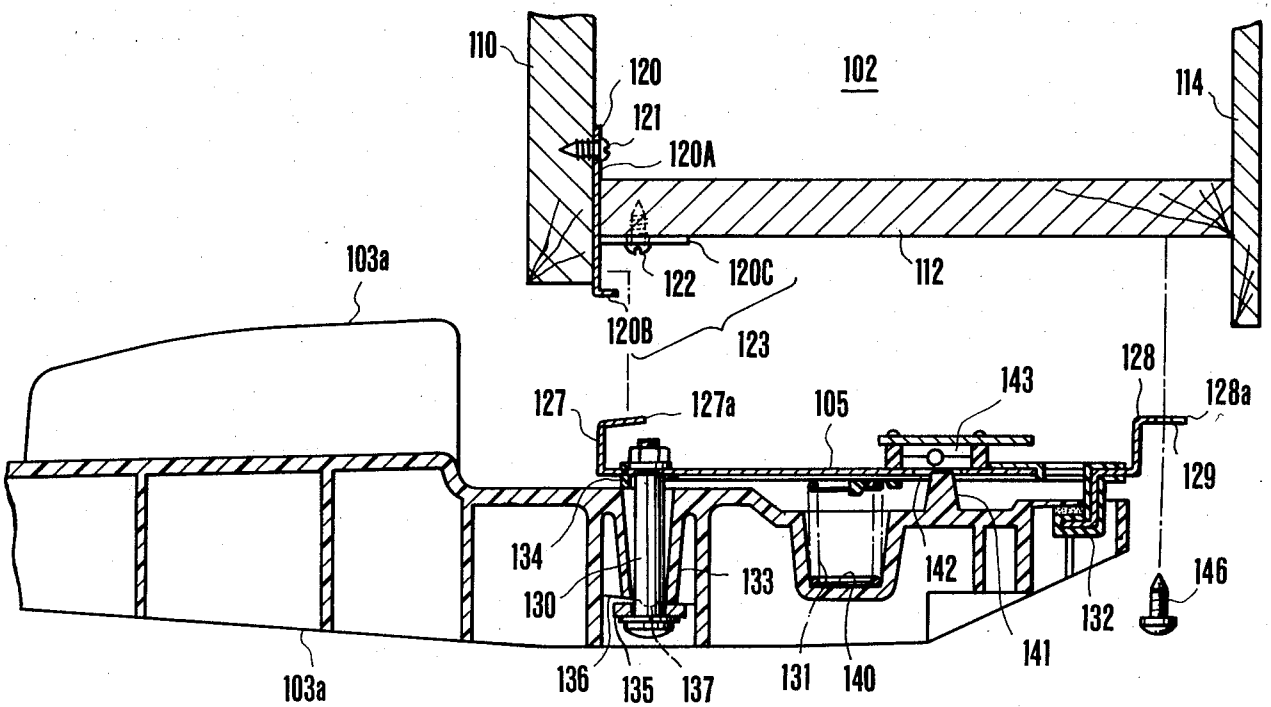
FIG. 9 is a side sectional view of a pedal keyboard for an electronic musical instrument according to another embodiment of the present invention before the keys are mounted in the frame.
Figure 10:
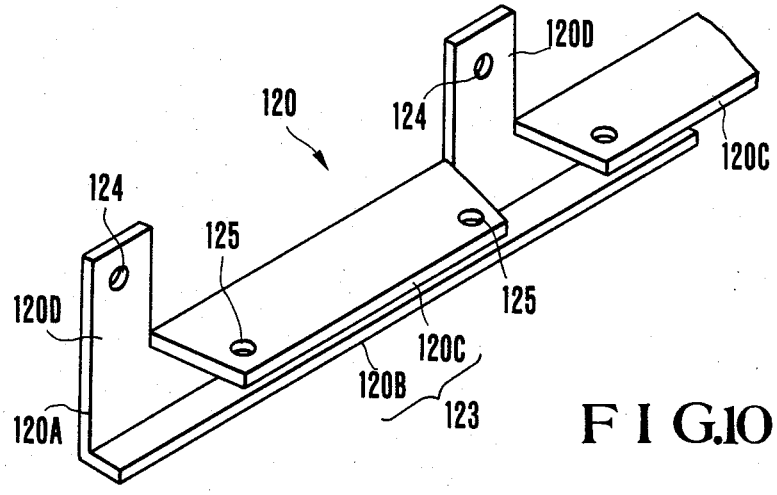
FIG. 10 is a perspective view showing the main part of a frame lock member.

There are various structures for mounting the pedal keyboard assembly on the musical instrument housing. In this case, it is essential to simply mount the pedal keyboard on the housing. In order to satisfy this condition, a mounting structure shown in FIG. 9 is adapted in the present invention. This mounting structure will be briefly described. The rear end portion of each pedal key **103*a* is vertically pivoted about a support shaft 130 extending downward from the front end of the lower surface of the frame 105 and is biased clockwise by a spring 131 disposed behind the support shaft 130. The rear end of the pedal key 103*a* is urged by the biasing force of the spring 131 on a hook-like stopper 132 mounted on the rear end of the lower surface of the frame 105. Elastic members 134 and 135 are mounted on the upper and lower surfaces of a cylindrical portion 133 which is mounted in the pedal key 103*a* and through which the support shaft 130 extends. The front half of the lower surface of the cylindrical portion 133 is cut downward obliquely at a proper angle so as to provide smooth pivotal movement, thereby constituting an inclined surface 136 which defines the effective length of the shaft 130. A projection 137 (corresponding to 23 of FIG. 5) which constitutes a pivot of the pedal key 103*a* extends at the central portion (along the longitudinal direction) of the lower surface of the cylindrical portion 133 along the direction perpendicular to the longitudinal direction of the pedal key 103*a*. The elastic member 134 inserted between the frame 105 and the upper surface of the cylindrical portion 133 has a rectangular sectional view and a C-shaped plan view. The lower surface of the open end of the elastic member 134 is cut obliquely in the lower left direction, thereby providing easy pivotal movement of the pedal key 103*a***.

An actuator 141 integrally extends from the rear end of the upper surface of the pedal key **103*a* behind a spring housing recess 140. A through hole 142 is formed and a switch 143 is arranged in the frame 105 in correspondence with each actuator 141. The switch 143 is operated by the actuator 141 upon depression of the pedal key 103*a*, thereby controlling the generation of the pedal musical tone in response to the signal from the switch 143**.

The mounting procedures of the pedal keyboard 103 on the housing 102 will be described.

Figure 11:
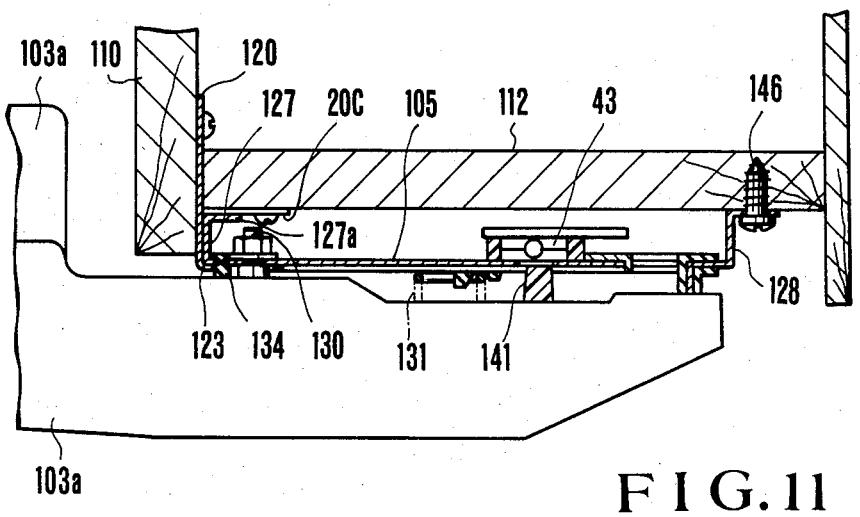
FIG. 11 is a side sectional view showing the state wherein the pedal keyboard is mounted on the lower surface of the bottom plate.

A predetermined number of pedal keys **103*a* are sequentially mounted on the lower surface of the frame 105, and the switches 143 are mounted on the upper surface of the frame 105 in correspondence with the actuators 141, thereby completing the assembly operation of the pedal keyboard 103. Thereafter, the resultant assembly is mounted by the frame lock member 120 and the set screws as the fastening means on the lower surface of the housing 102. As shown in FIG. 11, the engaging portion 127 of the frame 105 is engaged under pressure from the rear portion of the holding portion 123 of the frame lock member 120. Thereafter, the fixing member 128 is fixed by a set screw 146 at the rear end of the lower surface of the bottom board 112, thereby completing mounting of the pedal keyboard 103**.

Since the engaging portion 127 is inserted under pressure such that the horizontal portion **127*a* is in contact with the lower surface of the bottom board 112 and it is deformed downward, its vertical movement can be prevented. At the same time, the two end horizontal portions 127*a* are located outside the right and left bent portion 120B. The inner horizontal portions 127*a* are located between the adjacent upper end portions 120B and are in tight contact with the lower surface of the bottom board 112, thereby preventing right-and-left movement. Therefore, the pedal keyboard 103** can be located in the predetermined position.

According to the mounting structure of the pedal keyboard 103, since the pedal keyboard 103 can be mounted on the lower portion of the bottom board 112 from its lower side, the mounting operation can be easily performed at high speed as compared with the conventional mounting structure wherein the frame 105 is mounted in the housing 102, thereby achieving automatic assembly. Furthermore, since each engaging portion 127 of the frame 105 can be simply held by the holding portion 123 of the frame lock member 120 and the fixing member 128 is fixed by the set screw 146 on the lower surface of the bottom board, the total number of set screws 146 can be decreased by half, so that the mounting operation can be further simplified. Holes need not be formed in the bottom board 112, so that the mechanical strength of the housing 102 can be improved, and the housing can also be completely closed, thereby providing an electronic musical instrument with a good acoustic effect. In addition, since electronic parts such as a power source unit can be installed in a space between the bottom board 112 and the frame 105, the space factor of the housing 102 can be improved.

Figure 12:
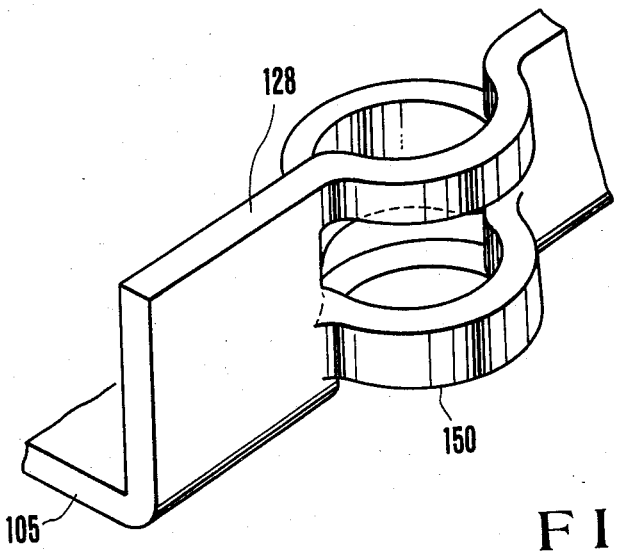
FIG. 12 is a perspective view showing another frame.

FIG. 12 shows another embodiment of the fixing portion 128 integrally formed with the lower end of a frame 105 which comprises a bent piece bent upward to be perpendicular to the frame 105. A plurality of semi-circular screw holes 150 are formed in a staggered manner along the direction of height of the fixing member 128. Screws are inserted in the holes 150 from the lower portion to fix the fixing member 128 on the lower surface of the bottom board.

Figure 13:
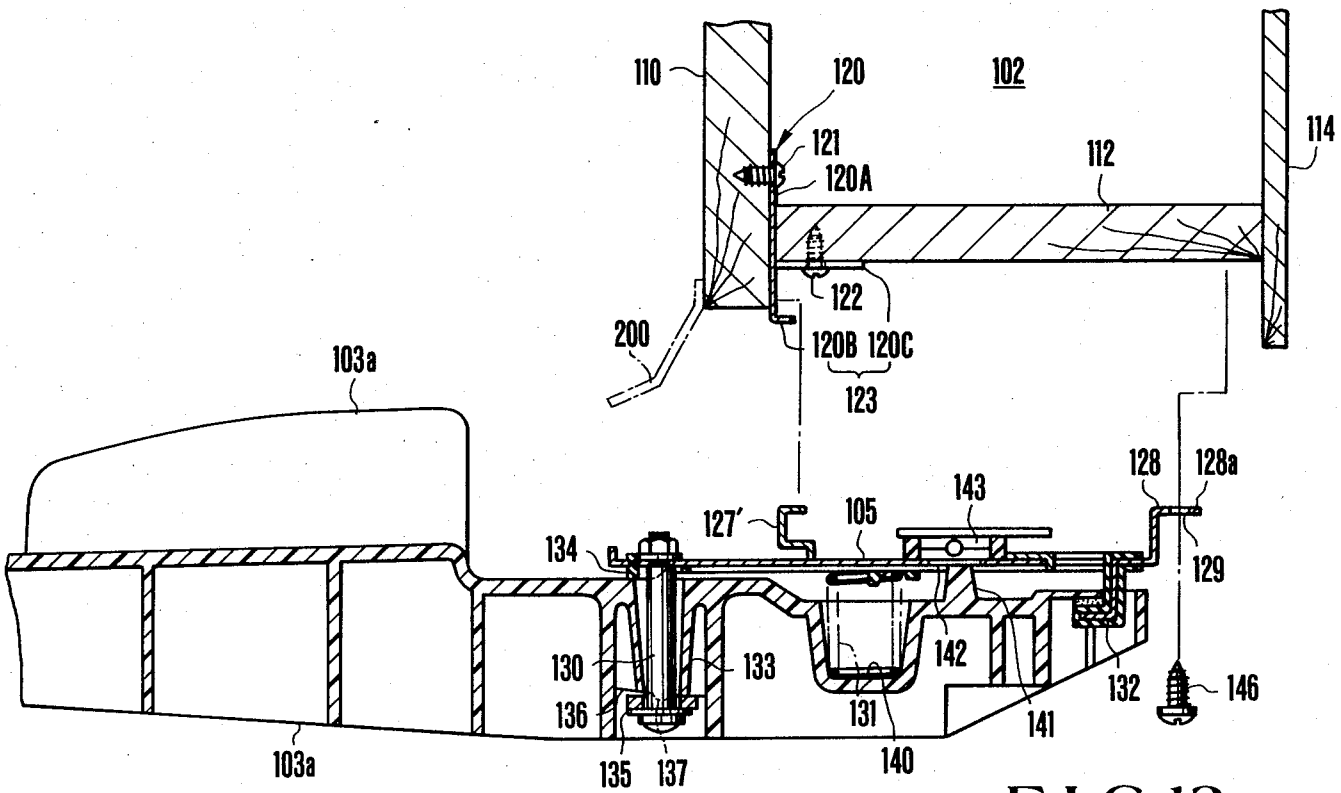
FIG. 13 is a side sectional view showing a pedal keyboard according to still another embodiment of the present invention.

FIG. 13 shows a modification of the above-mentioned embodiment. A pedal keyboard 103 is mounted in a housing 102 having a small distance between a front board 110 and a rear board 114. In this case, a plurality of engaging portions 127' such as partially punched and bent portions of the frame 105 are formed substantially at the center of the frame 105. The engaging portions 127' are inserted in a holding portion 123 from the rear side, and the rear portion of the fixing member 128 is screwed on the lower surface of a bottom board 112. The exposed pivot mechanism of the pedal keyboard 103 is covered with a cover 200 mounted on the lower portion of the front board.

The present invention is not limited to the above-mentioned structure. For example, the horizontal piece **127*a* of the lock portion 127 may be in tight contact with the lower surface of the lower bent portion 120B. The U-shaped members of the engaging and holding portions 127 and 123** may be formed in right-and-left opposing directions.

According to the pedal keyboard mounting structure of the electronic musical instrument as described above, the engaging portion of the frame is engaged under pressure with the holding portion of the frame lock member mounted on the front portion of the lower surface of the bottom or front board. The fixing portion formed at the rear end of the frame is fixed by the fastening means at the rear portion of the lower surface of the bottom board or the lower portion of the rear board. Therefore, the pedal keyboard can be mounted on the housing from the lower portion thereof, thereby improving mounting/removal operation. Furthermore, since the structures of the frame lock member and the frame are simple and holes need not be formed in the bottom board, the mechanical strength of the housing can be improved, and sound will not leak from the housing, thereby improving the acoustic effect.

Figure 14:
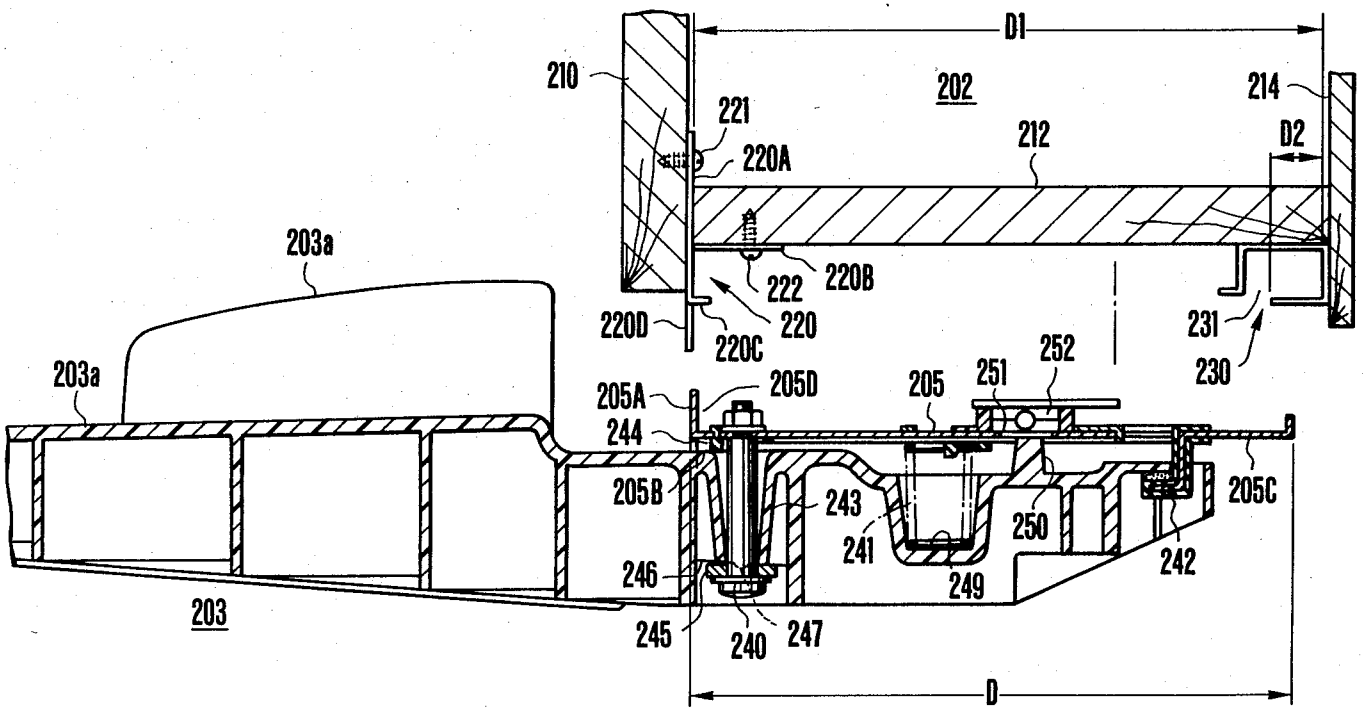
FIG. 14 is a side sectional view showing a pedal keyboard according to still another embodiment of the present invention.
Figure 15:
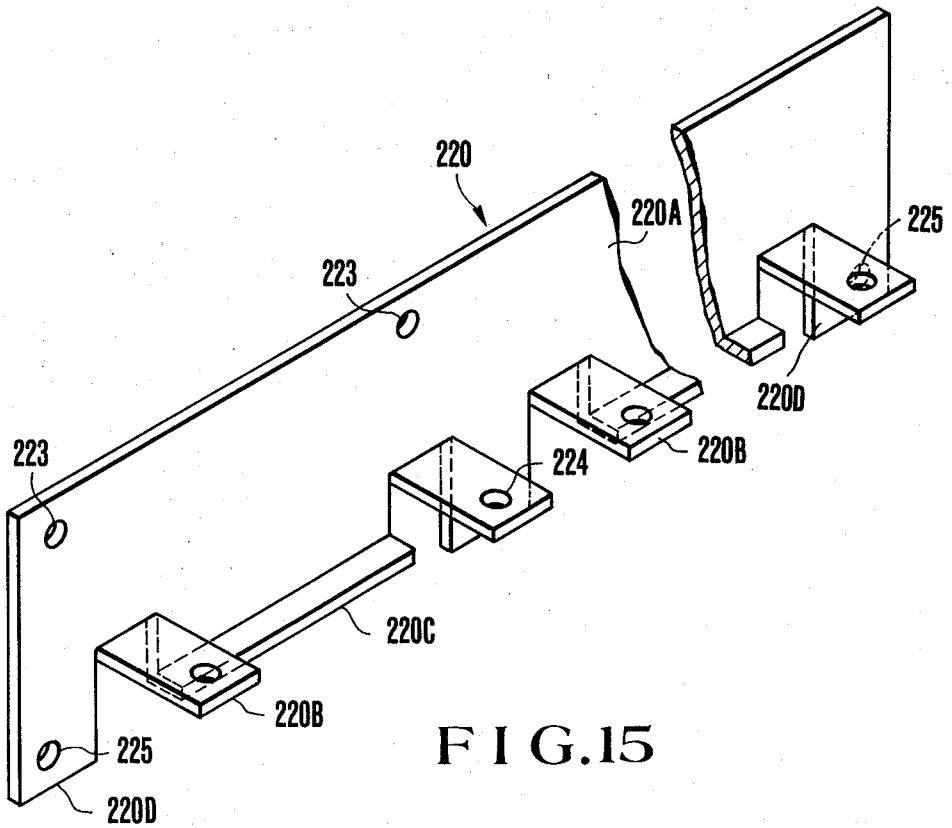
FIG. 15 is a perspective view showing the main part of a frame fixing member.

FIGS. 14 and 15 show a pedal keyboard mounting structure according to still another embodiment of the present invention. Referring to FIGS. 14 and 15, a frame fixing member 220 is mounted at the front end of the lower surface of a bottom board 212 bridging over a front board 210 and a rear board 214 to hold and fix the front end of a frame 205.

The frame fixing member 220 integrally comprises a flat base 220A which is obtained by metal plate pressing to extend along the right-and-left direction of a housing 202 and which is fixed by a set screw 221 on the lower portion of the inner wall surface of the front board 210, a plurality of bent portions 220B which are formed by bending the lower end of the base 220A at equal intervals along the longitudinal direction of the base 220A and which are respectively fixed by set screws 222 at the front end of the lower surface of the bottom board 212, and a plurality of guide frame lock portions 220C which are obtained such that the lower end portion of the base 220A is bent backward perpendicularly thereto at equal intervals along the longitudinal direction thereof. Each portion of the base 220A which does not have the bent portions 220B and the frame lock portions 220C and which extends downward constitutes a frame fixing portion 220D. The frame fixing portion 220D extends downward from the front board 210. The frame fixing portions 220D are formed between every adjacent pedal keys **203*a* and outside the two end pedal keys 203*a*. Screw holes 223, 224 and 225 are formed in the base 220A, the bent portions 220B and the frame fixing portions 220D**, respectively.

In this embodiment, the front end of the bottom board 212 is fixed at the lower end of the inner wall surface of the front board 210 through the frame fixing member 220. However, the present invention is not limited to the structure described above. For example, the front board 210 may be directly connected to the bottom board 212, and the frame fixing member may be fixed on the lower surface of the bottom board 212. In this case, the frame fixing member may have a substantially F-shaped cross-section. Furthermore, the frame fixing member 220 may be simply fixed at the lower portion of the front board 210.

A support member 230 having a prism shape obtained by bending a metal plate and a front open end of the lower surface is formed at the rear end of the lower surface of the bottom board 212 along the lower end of the inner wall surface of the rear board 214.

A frame 205 having the pedal keys **203*a* is flat in the same manner as in the conventional structure. However, a plurality of engaging portions 205A which are bent upward and which respectively correspond to the frame lock portions 220C of the frame fixing member 220 and a plurality of coupling portions 205B which are bent downward and which respectively correspond to the frame fixing portions 220D are integrally formed at the front end of the frame 205. The portions 205A and 205B constitute a fastening portion 205D. A portion 205C inserted in a support member 230 through an opening 231 thereof is integrally formed behind the fastening portion 205D. A distance D between the engaging portion 205A and the distal end of the portion 205C is smaller than a distance D1 ($D1>D$) between the frame fixing member 220 and the inner surface of the rear side of the support member 230. A difference between the distances D1 and D is smaller than a distance D2 between the inner surface of the rear side of the support member 230 and the opening 231. The portion 205C extends along the entire width of the frame 205. However, the portion 205C may comprise a plurality of portions formed at equal intervals in the same manner as in the engaging and coupling portions 205A and 205B**.

A structure for mounting the pedal keys **203*a* on the frame 205 will be briefly described. The rear end portion of the pedal key 203*a* is vertically pivotal about a support shaft 240 extending from the front end of the lower surface of the frame 205. The pedal key 203*a* is biased clockwise by a spring 241 mounted behind the support shaft 240. The rear end of the pedal key 203*a* is urged by the biasing force of the spring 241 on a hook-like stopper 242 mounted on the rear end of the lower surface of the frame 205. Elastic members 244 and 245 are mounted on the upper and lower surfaces of a cylindrical portion 243 through which the support shaft 240** for the pedal key 203*a* extends. The front half of the lower surface of the cylindrical portion 243 is cut obliquely in the lower right direction to provide smooth pivotal movement, thereby constituting an inclined surface 246. A projection 247 as a pivot extends at the central position (along the right-and-left direction) of the lower surface of the cylindrical portion 243 along a direction perpendicular to the longitudinal direction of the pedal key 203*a*. The elastic member 244 arranged on the upper surface side of the cylindrical portion 243 has a rectangular sectional view and a substantially C-shaped plan view. The lower surface of the open end of the cylindrical portion 243 is cut obliquely in the lower left direction so as to smoothly pivot the pedal key 203*a*.

An actuator 250 is integrally formed with the rear end of the upper surface of the pedal key 203*a* behind a spring housing recess 249. A through hole 251 is formed and a switch 252 is arranged in the frame 205 in correspondence with the actuator 250. The actuator 250 is operated upon depression of the pedal key 203*a*. The generation of the musical tone is controlled in response to the signal from the switch 252.

The mounting procedures of the pedal keyboard 203 on the housing 202 will be described with reference to FIGS. 16A, 16B and 16C.

A predetermined number of pedal keys 203*a* are sequentially mounted on the lower surface of the frame 205, and the switch 252 is arranged in correspondence with the actuator 250 of each key 203*a*, thereby completing the assembly operation of the pedal keyboard 203. Thereafter, the resultant assembly is mounted at the lower portion of the housing 202 by means of the frame fixing member 220, the support member 230 and fastening means (to be described later).

Figure 16A:
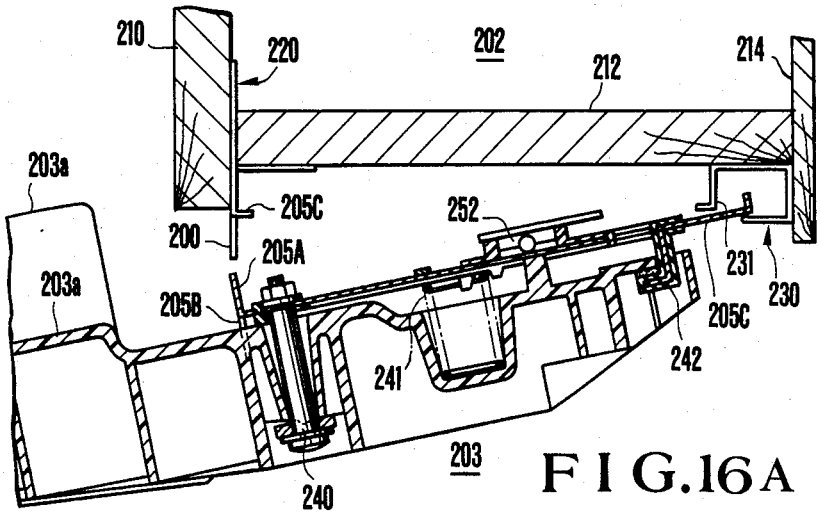
FIGS. 16A to 16C are sectional views showing the mounting procedures of the pedal keyboard of the present invention, respectively.
Figure 16B:
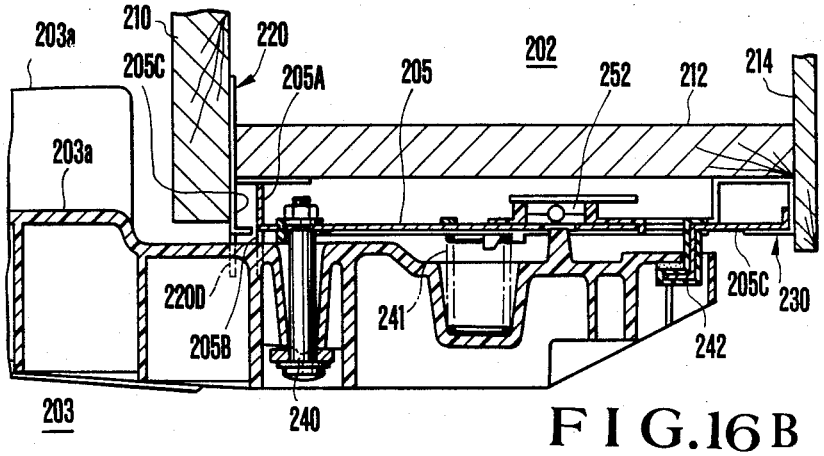
Figure 16C:
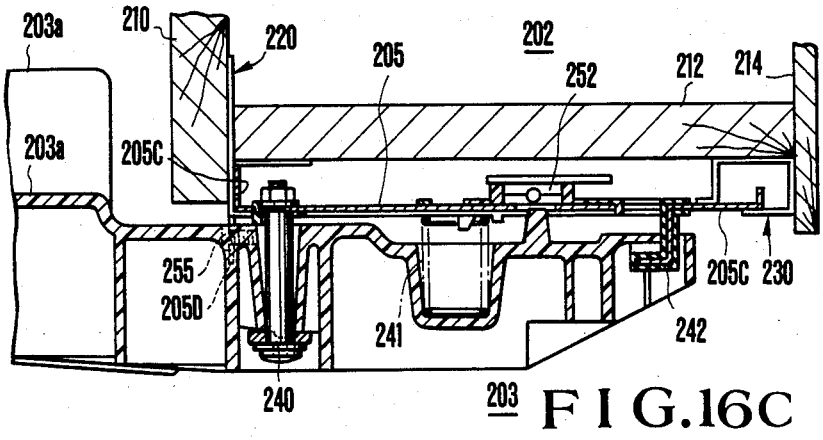

As shown in FIG. 16A, the front end of the frame 205 is inclined downward. The rear end of the frame 205 is inserted to full depth in the support member 230 through an opening 231 thereof. Thereafter, the front end of the frame 205 is moved upward while the insertion state is maintained, so that the frame 205 is kept substantially horizontal (FIG. 16B). When the frame 205 is pulled forward, the engaging portions 205A are placed on the corresponding frame lock portions 220C. At the same time, the coupling portions 205B are brought into tight contact with the inner wall surface (i.e., the rear surface) of the frame fixing portion 220D. The frame fixing portion 220D and the coupling portions 205B are fixed by fastening means 255 such as set screws and bolts (FIG. 16C) from the front side of the housing 202, thereby completing mounting of the pedal keyboard 203. When the frame 205 is held horizontally and pulled forward, the portion 205C will not be removed from the support member 230 due to the above-mentioned relationship among the distances D, D1 and D2.

According to the mounting structure described above, since the pedal keyboard 203 can be mounted at the lower portion of the bottom board 212 from the lower portion of the housing 202, the mounting operation can be easily performed at high speed as compared with the conventional mounting structure wherein the frame 205 is mounted in the housing 202, thereby improving the assembly operation. Furthermore, since the portion 205C of the frame 205 is simply supported by the support member 230, and the frame fixing member 220 and the fastening portion 205D of the frame 205 are fixed by the fastening means 255, the required number of fastening means 255 can be decreased by half, thereby further simplifying the mounting operation. In addition, holes and openings need not be formed in the bottom board 212 and the rear board 214, so that the mechanical strength of the housing 202 can be improved, and the housing 202 can be completely closed, thereby providing an electronic musical instrument with a good acoustic effect. Electronic fittings such as a power source unit can be inserted between the bottom board 212 and the frame 205, so that the space factor in the housing 202 can be improved.

Figure 17:
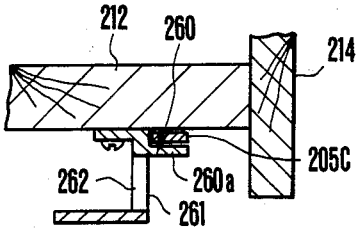
FIG. 17 is a side sectional view showing the main part of a pedal keyboard according to still another embodiment of the present invention.

FIG. 17 is a side sectional view showing another embodiment of the support member. A support member 260 fixed at the rear end portion of the lower surface of a bottom board 212 comprises a substantially crank-shaped member. A lower horizontal portion 260*a* of the support member 260 is inserted from the front side of an engaging hole 262 formed in a vertical piece 261 of a hook-like portion 205C integrally formed with the rear end portion of the frame 205, thereby supporting the portion 205C on the support member 260.

The present invention is not limited to the structure described above. For example, the shape and number of frame lock portions 220C of the frame fixing member 220, frame fixing portion 220D and support members 230 and 260 are not limited to those described above.

According to the pedal keyboard mounting structure of the electronic musical instrument, the frame is held by the frame fixing member and the support member which are respectively mounted on the front portion of the lower surface of the bottom board or the lower portion of the front board and the rear portion of the bottom board or the lower portion of the rear board. At the same time, the frame is fastened by the fastening means on the frame fixing member. Therefore, the pedal keyboard can be mounted on the housing from the lower portion thereof, thereby improving the mounting/removal operation of the keyboard. Furthermore, since the frame fixing member and the support member have a simple structure, and holes need not be formed in the bottom board, the mechanical strength of the housing can be improved, and sound leakage is reduced to improve the acoustic effect.

What is claimed is:

1. A pedal keyboard for an electronic musical instrument, comprising:

a pedal key means including a pivot mechanism and pedal key member having a front end portion and a rear end portion for generating a musical tone, said pedal key member being vertically pivotal about said pivot mechanism and mounted on a frame which is fixed to a body of the musical instrument;

a spring for biasing said pedal key member so as to cause said pedal key member to return to an initial position; and a stopper for limiting pivotal movement of said pedal key member, said pivot mechanism being disposed adjacent to said front end portion of said pedal key member, said stopper being disposed distally to said pedal key member and said spring being disposed between said pivot mechanism and said stopper.

2. A keyboard according to claim 1, wherein said pivot mechanism includes a pivot shaft having one end fixed on said frame and extending through a hole formed in said pedal key member, said pivot shaft being provided at the other end thereof with a support means serving as a fulcrum portion for the pivotal movement of the pedal key member.

3. A keyboard according to claim 2, further comprising a length regulating means for defining an effective length of said pivot shaft.

4. A keyboard according to claim 2, wherein said hole is tapered from an upper portion of the shaft toward said fulcrum portion.

5. A keyboard according to claim 2, wherein said support means and a front engaging portion of said pedal key member which is engaged with said support means provide a gap therebetween when said pedal key member is not depressed.

6. A keyboard according to claim 5, further comprising an elastic member disposed in said gap, said gap being formed such that a front end of said hole which opposes said elastic member comprises a surface which is inclined when the pedal key member is not depressed.

7. A keyboard according to claim 6, wherein a projection is formed in said front engaging portion of said pedal key member along a direction perpendicular to a longitudinal direction of said pedal key member.

8. A keyboard according to claim 1, wherein said pivot mechanism of said pedal key means comprises:

a hole formed in said pedal key member;

a pair of elastic members arranged at two sides of said hole; and a pivot shaft which extends through said pair of elastic members and said hole and which has one end fixed on said frame, said pivot shaft being provided at the other end thereof with a support means serving as a fulcrum portion for the pivotal movement of the pedal key member.

9. A keyboard according to claim 1, wherein said frame and a frame engaging portion of said pedal key member which is engaged with said frame provide a gap therebetween when said pedal key member is not depressed.

10. A keyboard according to claim 9, wherein said gap is formed by an elastic member inserted between said frame and said pedal key member.

11. A keyboard according to claim 10, wherein said elastic member inserted between said frame and said pedal key member has an inclined surface which is located at a side of said pivot shaft facing a rear end side of said pedal key member, thereby providing said gap between said frame and the rear end side of said pedal key member when said pedal key is not depressed.

12. A keyboard according to claim 11, wherein said inclined surface is formed to cross said support shaft.

13. A keyboard according to claim 1, wherein said pivot mechanism includes a pivot shaft having one end fixed on said frame end extending through a hole formed in said pedal key member, said pivot shaft being provided at the other end thereof with a support means serving as a fulcrum portion for the pivotal movement of the pedal key member, and wherein gaps are formed between said support means and a front engaging portion of said pedal key member and between said frame and a rear engaging portion of said pedal key member when said pedal key member is not depressed.

14. A keyboard according to claim 1, wherein said stopper is formed at said rear end portion of said pedal key member.

15. A keyboard according to claim 14, wherein said stopper comprises a lower limit stopper extending downward from said frame and an upper limit stopper constituted by a lower surface of said frame.

16. A keyboard according to claim 14, wherein each of said stoppers comprises an elastic material.

17. A keyboard according to claim 15, wherein said upper limit stopper has a buffer member thereon.

18. A keyboard according to claim 17, wherein the elastic material of said upper limit stopper has a plurality of projections parallel to a longitudinal direction of said pedal key member, said projections being provided with different heights.

19. A keyboard according to claim 1, wherein said spring has one end received in a recess formed in said pedal key member and the other end locked by a movement preventing projection formed in the lower surface of said frame.

20. A keyboard according to claim 19, wherein said spring comprises a coil spring whose outer diameter is substantially the same as a diameter of a bottom portion of said recess.

21. A keyboard according to claim 19, wherein said movement preventing projection comprises an elastic material.

22. A keyboard according to claim 8, wherein said spring has one end received in a recess formed in said pedal key member and the other end locked by a movement preventing projection formed in the lower surface of said frame, said elastic member inserted between said frame and said pedal key member and said movement preventing projection formed on the lower surface of said frame being formed by outsert molding.

23. A keyboard according to claim 1, wherein said frame has a C-shaped lock portion at its front end portion on a side facing the body of the instrument, a rear end of said frame is provided with a screw hole, and said body of the instrument has a hook portion engaged with said C-shaped lock portion, whereby said frame is fixed on said instrument such that said C-shaped lock portion is locked in said hook portion and that the rear end is fixed through said screw hole.

24. A keyboard according to claim 23, wherein the rear end of said frame is provided with a bent portion which is bent to be perpendicular to a longitudinal direction of said frame, said bent portion being provided with semicircular grooves staggered along a direction of height thereof and alternately arcuated in opposite directions.

25. A keyboard according to claim 1, wherein said body of the instrument comprises a lock portion for locking a rear end of said frame and a fastening portion opposing a front end of said frame, said fastening portion being constituted by a frame engaging portion which is engaged with the front end of said frame, and fixing means fixes the front end of said frame to said frame engaging portion.

26. A keyboard according to claim 25, wherein said lock portion has a structure for guiding said frame along a back-and-forth direction thereof.

27. A keyboard according to claim 26, wherein said frame engaging portion comprises a guide portion for causing said frame to move toward said front end of said pedal key member while said frame is locked with said lock portion.

* * * * *

REEXAMINATION CERTIFICATE (1041st)

United States Patent [19] [11] B1 4,653,378

Watanabe et al. [45] Certificate Issued Apr. 18, 1989

[54] PEDAL KEYBOARD FOR ELECTRONIC MUSICAL INSTRUMENT

[75] Inventors: Keisuke Watanabe; Toshiyuki Iwamoto, both of Shizuoka, Japan

[73] Assignee: Nippon Gakki Seizo Kabushiki Kaisha, Hamamatsu, Japan

Reexamination Request:
No. 90/001,357, Oct. 22, 1987

Reexamination Certificate for:

| | |
|---|---|
| Patent No.: | **4,653,378** |
| Issued: | **Mar. 31, 1987** |
| Appl. No.: | **734,952** |
| Filed: | **May 16, 1985** |

[30] Foreign Application Priority Data

| | | | |
|---|---|---|---|
| May 25, 1984 | [JP] | Japan | 59-75874[U] |
| May 25, 1984 | [JP] | Japan | 59-75875[U] |
| Jan. 9, 1985 | [JP] | Japan | 60-494[U] |
| Feb. 14, 1985 | [JP] | Japan | 60-18365[U] |

[51] Int. Cl.[4] ..... G10C 3/12

[52] U.S. Cl. ..... 84/423 R; 84/366; 84/434; 84/444

[58] Field of Search ..... 84/225-231, 84/366, 423 R, 426, 430–436, 444

[56] References Cited

U.S. PATENT DOCUMENTS 3,903,780 9/1975 Aliprandi ..... 84/433

*Primary Examiner*—Benjamin R. Fuller

[57] ABSTRACT

A pedal keyboard for an electronic musical instrument, includes a pedal key vertically pivotal about a pivot mechanism mounted on a frame of a housing for the electronic musical instrument, a spring for biasing the pedal key so as to cause the pedal key to return to an initial position, and a stopper for limiting pivotal movement of the pedal key. The spring is arranged behind the pivot mechanism of the pedal key, and the stopper is arranged behind the spring, thereby improving key depression feeling and forming a gap in the pivot mechanism to achieve smooth pivotal movement of the key.

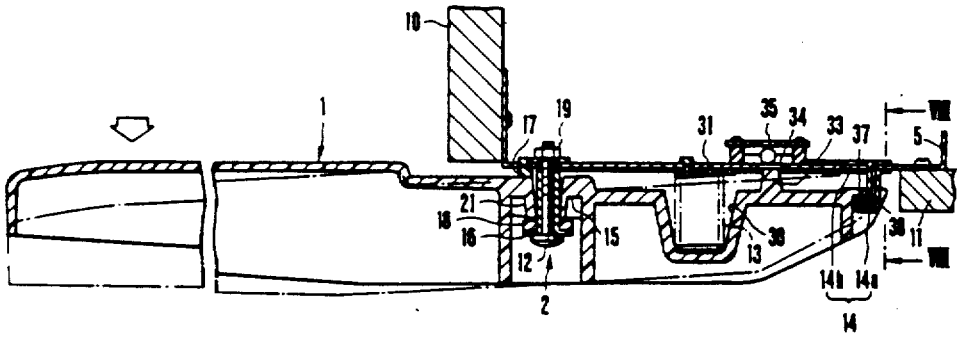

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2 and 5 are cancelled.

Claims 3, 4, 6, 8, 9, 13, 14, 19, 23 and 25 are determined to be patentable as amended.

Claims 7, 10–12, 15–18, 20–22, 24, 26 and 27, dependent on an amended claim, are determined to be patentable.

New claim 28 is added and determined to be patentable.

3. A keyboard according to claim [2] *28*, further comprising a length regulating means for defining an effective length of said pivot shaft.

4. A keyboard according to claim [2] *28*, wherein said hole is tapered from an upper portion of the shaft toward said fulcrum portion.

6. A keyboard according to claim [5] *28*, further comprising an elastic member disposed in said gap, said gap being formed such that a front end of said hole which opposes said elastic member comprises a surface which is inclined when the pedal key member is not depressed.

8. A keyboard according to claim [1] *28*, wherein said pivot mechanism of said pedal key means comprises:

a hole formed in said pedal key member;

a pair of elastic members arranged at two sides of said hole; and a pivot shaft which extends through said pair of elastic members and said hole and which has one end fixed on said frame, said pivot shaft being provided at the other end thereof with a support means serving as a fulcrum portion for the pivotal movement of the pedal key member.

9. A keyboard according to claim [1] *28*, wherein said frame and a frame engaging portion of said pedal key member which is engaged with said frame provide a gap therebetween when said pedal key member is not depressed.

13. A keyboard according to claim [1] *28*, wherein said pivot mechanism includes a pivot shaft having one end fixed on said frame end extending through a hole formed in said pedal key member, said pivot shaft being provided at the other end thereof with a support means serving as a fulcrum portion for the pivotal movement of the pedal key member, and wherein gaps are formed between said support means and a front engaging portion of said pedal key member and between said frame and a rear engaging portion of said pedal key member when said pedal key member is not depressed.

14. A keyboard according to claim [1] *28*, wherein said stopper is formed at said rear end portion of said pedal key member.

19. A keyboard according to claim [1] *28*, wherein said spring has one end received in a recess formed in said pedal key member and the other end locked by a movement preventing projection formed in the lower surface of said frame.

23. A keyboard according to claim [1] *28*, wherein said frame has a C-shaped lock portion at its front end portion on a side facing the body of the instrument, a rear end of said frame is provided with a screw hole, and said body of the instrument has a hook portion engaged with said C-shaped lock portion, whereby said frame is fixed on said instrument such that said C-shaped lock portion is locked in said hook portion and that the rear end is fixed through said screw hole.

25. A keyboard according to claim [1] *28*, wherein said body of the instrument comprises a lock portion for locking a rear end of said frame and a fastening portion opposing a front end of said frame, said fastening portion being constituted by a frame engaging portion which is engaged with the front end of said frame, and fixing means fixes the front end of said frame to said frame engaging portion.

*28. In a electronic musical instrument having a pedal keyboard including:*

*pedal key means including a pivot mechanism and pedal key member having a front end portion and a rear end portion for generating a musical tone, said pedal key member being vertically pivotal about said pivot mechanism and mounted on a frame which is fixed to a body of the musical instrument;*

*a spring for biasing said pedal key member so as to cause said pedal key member to return to an initial position; and*

*a stopper for limiting pivotal movement of said pedal key member,*

*the improvement wherein said pivot mechanism is disposed adjacent to said front end portion of said pedal key member, said stopper is disposed distally to said pedal key member and said spring is disposed between said pivot mechanism and said stopper, and wherein said pivot mechanism includes a pivot shaft having one end fixed on said frame and extending through a hole formed in said pedal key member, so that a clearance allowing pivotal movement of said pedal key member is formed between said pivot shaft and said pedal key member, said pivot shaft being provided at the other end thereof with a support means serving as a fulcrum portion for the pivotal movement of the pedal key member, and wherein said support means and a front engaging portion of said pedal key member which is engaged with said support means provide a gap therebetween when said pedal key member is not depressed, said gap being formed such that an end of said hole comprises a surface which is inclined when the pedal key member is not depressed.*

* * * * *